US005149257A

United States Patent [19]

Iio

[11] Patent Number: 5,149,257

[45] Date of Patent: Sep. 22, 1992

[54] COMPRESSOR WITH A CYLINDER HAVING IMPROVED SEIZURE RESISTANCE AND IMPROVED WEAR RESISTANCE, AND METHOD OF MANUFACTURING THE CYLINDER

[75] Inventor: Masahiro Iio, Konan, Japan

[73] Assignee: Diesel Kiki Co., Ltd., Tokyo, Japan

[21] Appl. No.: 806,856

[22] Filed: Dec. 9, 1991

Related U.S. Application Data

[63] Continuation of Ser. No. 482,207, Feb. 20, 1990, abandoned.

[30] Foreign Application Priority Data

Mar. 29, 1989 [JP] Japan ..... 1-35961[U]

[51] Int. Cl.[5] ..... F04C 18/344; F04C 29/00; F01B 31/00

[52] U.S. Cl. ..... 418/178; 418/179; 92/169.2

[58] Field of Search ..... 418/178, 179; 92/169.1, 92/169.2

[56] References Cited

U.S. PATENT DOCUMENTS

| | | | |
|---|---|---|---|
| 1,775,358 | 9/1930 | Smith | 92/169.1 |
| 3,165,983 | 1/1965 | Thomas | 92/169.1 |
| 3,878,880 | 4/1975 | Jones | 418/178 |
| 4,000,011 | 12/1976 | Sato et al. | 418/178 |
| 4,297,976 | 11/1981 | Bruni et al. | 92/169.1 |
| 4,515,513 | 5/1985 | Hayase et al. | 418/178 |
| 4,744,738 | 5/1988 | Miki et al. | 418/178 |

FOREIGN PATENT DOCUMENTS

| | | | |
|---|---|---|---|
| 55-14966 | 2/1980 | Japan . | |
| 58-3946 | 1/1983 | Japan | 418/179 |
| 58-67989 | 4/1983 | Japan | 418/178 |
| 62-30838 | 2/1987 | Japan . | |
| 62-32293 | 2/1987 | Japan | 418/178 |
| 62-48984 | 3/1987 | Japan . | |

*Primary Examiner*—John J. Vrablik

*Attorney, Agent, or Firm*—Frishauf, Holtz, Goodman & Woodward

[57] ABSTRACT

A compressor has a cylinder formed of an aluminum alloy, and a moving member slidably received within the cylinder. Hard particles are dispersed in the inner peripheral surface portion of the cylinder. The hard particles are formed of a chemical compound such as a nitride and a carbide. The cylinder is manufactured by preparing a first green compact formed of a mixture of a powdery material for the aluminum alloy and the hard particles and a second green compact formed solely of the powdery material, preparing a billet having an inner layer formed of the first green compact, and an outer layer formed of said second green compact, placing the billet in a preheated state into a container and further heating same therein, and fitting a mandrel through a central bore of the billet and pressurizing the billet to extrude same through a die hole in a die.

6 Claims, 4 Drawing Sheets

COMPRESSOR WITH A CYLINDER HAVING IMPROVED SEIZURE RESISTANCE AND IMPROVED WEAR RESISTANCE, AND METHOD OF MANUFACTURING THE CYLINDER

This application is a continuation of application Ser. No. 07/482,207, filed Feb. 20, 1990, abandoned.

This invention relates to compressors adapted for use as refrigerant compressors for automotive air conditioners, and more particularly to such compressors which have cylinders formed of aluminum alloys.

Conventional vane compressors for use in automotive air conditioners for automotive vehicles are generally comprised of a cylinder, a rotor rotatably received within the cylinder, and vanes radially movably inserted in slits of the rotor. Many such vane compressors employ cylinders formed of aluminum alloys in order to meet the requirement for reduction in the weight. Further, it is required for the aluminum alloy cylinders to have inner peripheral surfaces (camming surfaces) with improved seizure resistance as well as improved wear resistance so as to cope with the recent tendency of increased rated rotational speed of compressors.

To improve the wear resistance of the inner peripheral surface of the aluminum alloy cylinder, there are known the following conventional methods:

1) The inner peripheral surface of the cylinder is coated with an anodic oxide (alumite), as proposed by Japanese Provisional Patent Publication (Kokai) No. 55-14966;

2) The inner peripheral surface of the cylinder is coated with a ceramic, as proposed by Japanese Provisional Patent Publication (Kokai) No. 62-48984; and 3) In forming the cylinder by an aluminum alloy powder extrusion method which comprises extruding a sintered billet formed of an aluminum alloy compact in such a manner that the sintered billet is pressurized within a container by means of a stem to be extruded into a tubular shape through a die hole, an aluminum alloy compact in which silicon (Si) is contained in an increased amount evenly throughout the whole body of the compact, or one in which hard particles of a nitride such as $Si_3N_4$ or a carbide such as TiC or SiC are evenly dispersed throughout the whole body of the compact, as proposed, e.g. by Japanese Provisional Patent Publication (Kokai) No. 62-30838.

However, according to the method 1), although the alumite treatment is inexpensive, the inner peripheral surface of the cylinder still has insufficient seizure resistance if used as a sliding surface in a vane compressor for automotive air conditioners, on which the tips of vanes slide under high pressure, so that biting or seizure of the sliding parts can take place.

According to the method 2), the ceramic coating is made by means of thermal spraying, CVD (Chemical Vapor Deposition), or a like method. However, these ceramic coating methods are rather expensive. Further, since the coated ceramic and the aluminum alloy cylinder have different thermal expansion coefficients, cracks can be formed in the ceramic coating layer, and the ceramic coating layer can be exfoliated from the inner peripheral surface of the cylinder.

The method 3) has the disadvantage that the billet has rather high hardness throughout its whole body and hence low extrusion formability, resulting in a poor production yield. Thus this method is difficult to put into practice.

SUMMARY OF THE INVENTION

It is therefore an object of the invention to provide a compressor in which the cylinder has improved seizure resistance as well as improved wear resistance.

It is a further object of the invention to provide a method of manufacturing a cylinder having improved seizure resistance and improved wear resistance from a billet having high extrusion formability, thus providing a high production yield.

According to the invention, there is provided a compressor having a cylinder formed of an aluminum alloy and having an inner peripheral surface portion, and a moving member slidably received within the cylinder.

The compressor is characterized in that hard particles are dispersed in the inner peripheral surface portion of the cylinder.

Preferably, the hard particles are formed of a chemical compound selected from the group consisting of a nitride and a carbide, and more preferably a chemical compound selected from the group consisting of $Si_3N_4$, TiC, and SiC.

The hard particles are contained in an amount of 1 to 8 percent by weight, preferably approximately 3 percent by weight.

Preferably, the hard particles have a mean particle size of not more than approximately 10 microns.

Preferably, the aluminum alloy consists essentially of 13–17 percent by weight Si, 3–5 percent by weight Cu, 3–5 percent by weight Fe, and the balance of Al and inevitable impurities.

According to the invention, there is also provided a method of manufacturing a cylinder for use in a compressor, the cylinder having an inner peripheral surface portion and being formed of an aluminum alloy, the method comprising the steps of:

(1) preparing a first green compact by adding to a powdery material having a predetermined chemical composition for forming the aluminum alloy hard particles formed of a chemical compound selected from the group consisting of a nitride and a carbide, mixing the powdery material and the hard particles together, and compacting the resulting mixture;

(2) preparing a second green compact formed solely of the powdery material;

(3) preparing a billet having an inner layer formed of first green compact, and an outer layer formed of said second green compact, the billet having a central bore formed therethrough;

(4) placing the billet in a preheated state into a container and further heating same therein; and (5) fitting a mandrel through the central bore of billet and pressurizing the billet by a stem to extrude same through a die hole in a die.

The above and other objects, features, and advantages of the invention will be more apparent from the ensuing detailed description taken in conjunction with the accompanying drawings.

DETAILED DESCRIPTION

The invention will now be described in detail with reference to the drawings.

Figure 1:
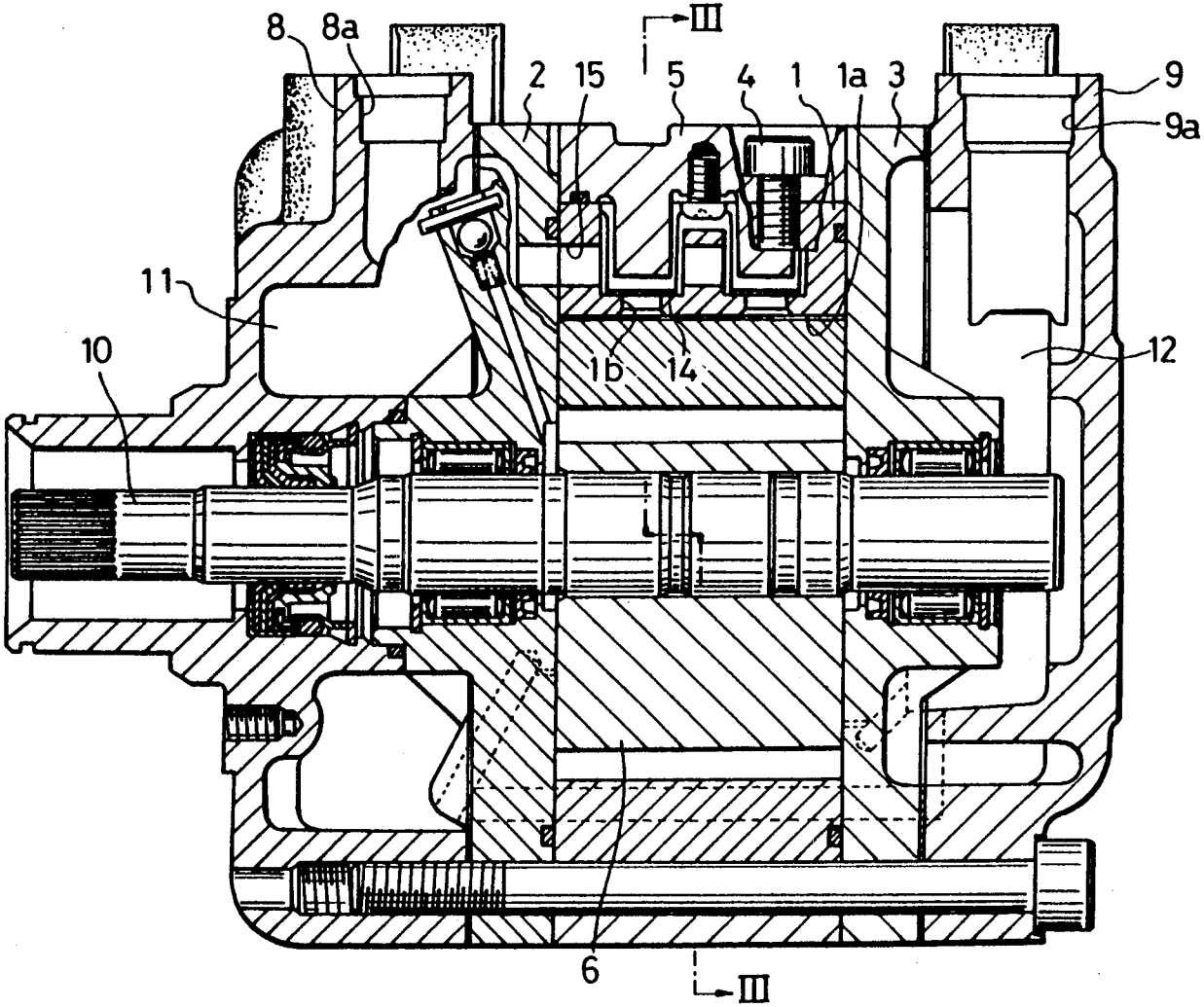
FIG. 1 is a longitudinal cross-sectional view of a vane compressor according to an embodiment of the invention.
Figure 2:
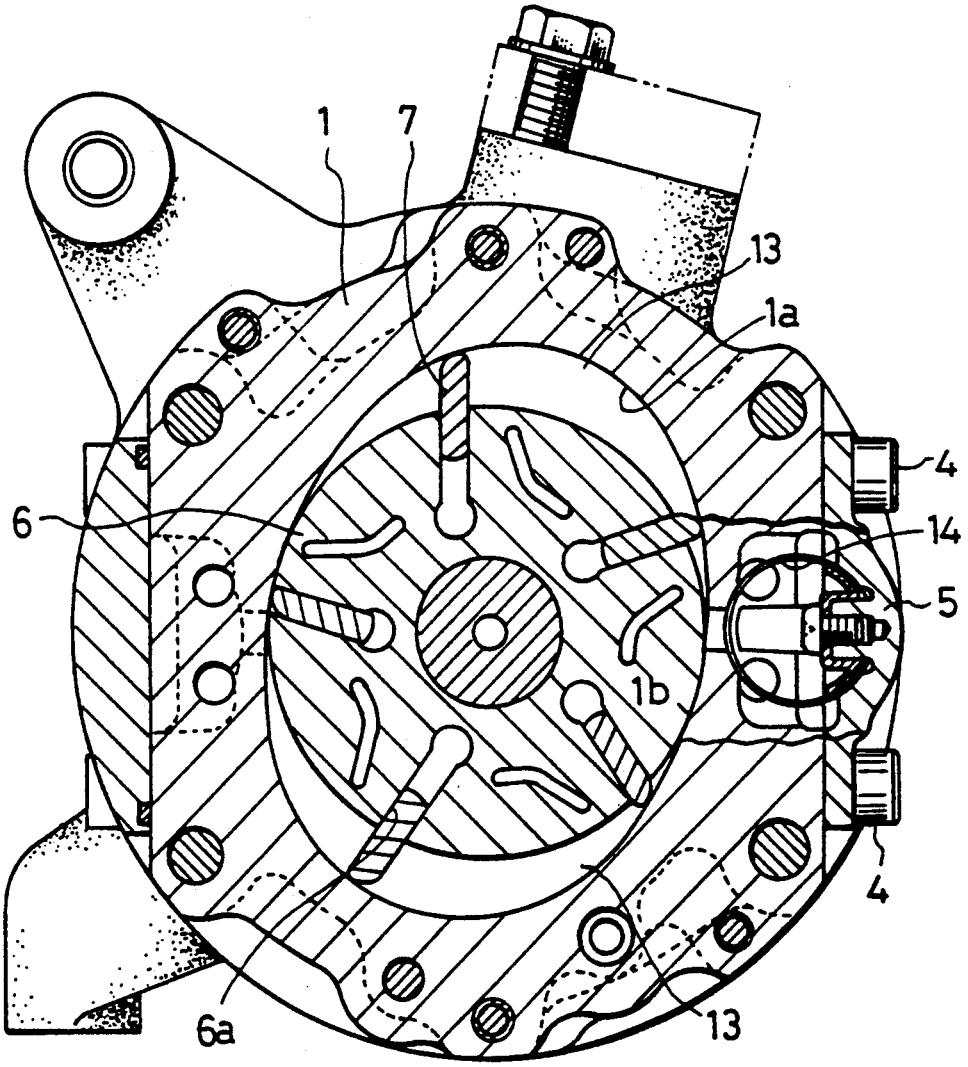
FIG. 2 is a transverse cross-sectional view taken along line II—II in FIG. 1.

Referring first to FIGS. 1 and 2, there is illustrated a vane compressor according to an embodiment of the invention, for use in an automotive air conditioner. The compressor is comprised of a cylinder formed by a cam ring 1 formed of an aluminum alloy and having an inner peripheral surface (camming surface) 1*a* with an elliptical cross section, and front and rear side blocks 2, 3 secured to opposite open ends of the cam ring 1 in a manner closing same, two diametrically opposite discharge valve covers 5, only one of which is shown, each secured by bolts 4 to an outer peripheral surface of the cam ring 1, a cylindrical rotor 6 rotatably received within the cylinder, vanes 7 as a moving member radially slidably inserted in vane slits 6*a* of the rotor 6, front and rear heads 8, 9 secured to outer end faces of the respective side blocks 2, 3, and a driving shaft 10.

A discharge port 8*a*, through which a thermal medium or refrigerant is to be discharged to the outside, is formed in an upper portion of the front head 8, while a suction port 9*a*, through which refrigerant is to be drawn into the compressor, is formed in an upper portion of the rear head 9. The discharge port 8*a* opens into a discharge pressure chamber 11 defined by the front head 8 and the front side block 2, while the suction port 9*a* opens into a suction chamber 12 defined by the rear head 9 and the rear side block 3.

With the above arrangement, refrigerant drawn into the suction chamber 12 through the suction port 9*a* is further drawn into compression chambers 13 defined between the inner peripheral surface 1*a* of the cam ring 1, the outer peripheral surface of the rotor, and the inner end faces of the front and rear side blocks 2, 3, through inlet ports, not shown, formed in the rear side block 3. The refrigerant is compressed within the compression chambers 13 and discharged into the discharge pressure chamber 11 through outlet ports 1*b* formed in the cam ring 1, discharge valves 14, and discharge passages 15, to be discharged into an external refrigerating circuit, not shown, through the discharge port 8*a*.

Figure 3:
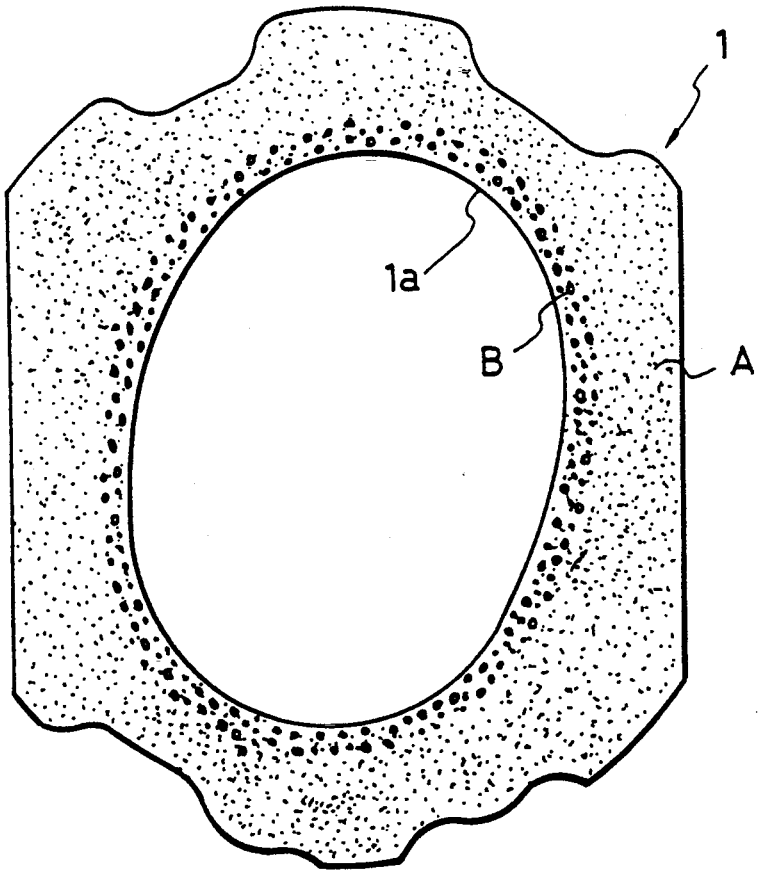
FIG. 3 is a schematic sectional view schemically showing the metallic structure of a cylinder formed of an aluminum alloy used in the compressor according to the invention.

FIG. 3 schematically shows a cross section of the metallic structure of the cam ring 1 of the aluminum alloy cylinder. The whole cam ring 1 is formed of a aluminum alloy A. The aluminum alloy A preferably consists essentially of 13–17% by weight Si, 3–5% by weight Cu, 3–5% by weight Fe, and the balance of Al and inevitable impurities. The cam ring 1 formed of the aluminum alloy A is manufactured by subjecting a green compact of a powdery material having the above chemical composition to hot extrusion.

Hard particles B, which are preferably particles of a nitride such as $Si_3N_4$, or a carbide such as TiC or SiC, are dispersed in an inner peripheral surface portion of the cam ring 1. The particles B are contained in the inner peripheral surface portion of the cam ring 1 in an amount falling within a range of 1 to 8 percent by weight, preferably approximately 3 percent. Preferably, the hard particles B have a mean particle size of not more than approximately 10 microns.

Figure 4:
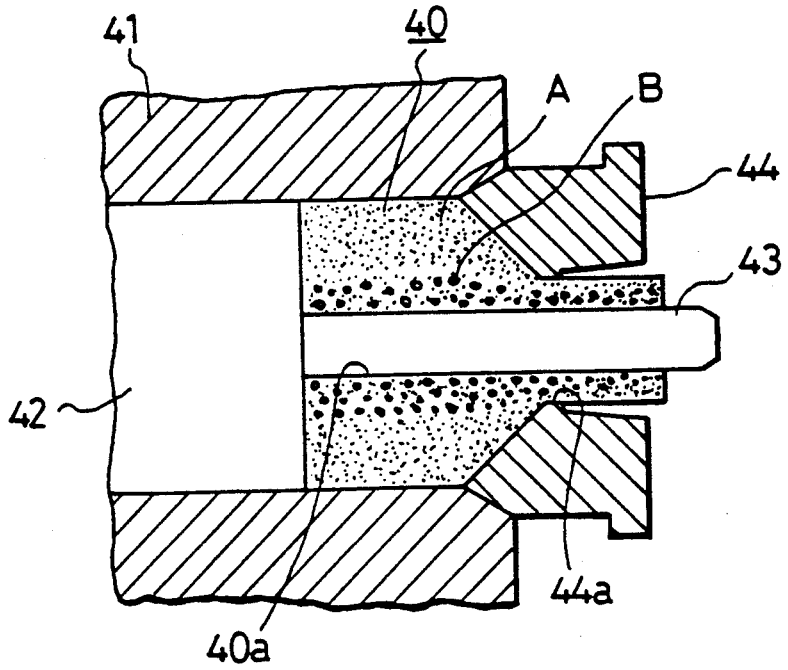
FIG. 4 is a sectional view of a die and a billet, useful in explaining an aluminum alloy powder-extrusion method according to the invention.

The manner of manufacturing the cam ring formed of the aluminum alloy A will described in detail with reference to FIGS. 4 and 5:

(1) First, the hard particles B are added in an amount falling within the above-mentioned range to a powdery material having the above-mentioned chemical composition of the aluminum alloy A, and mixed together. The resulting mixture is compacted into a first green compact in which the hard particles B are evenly dispersed;

(2) A powdery material having the above-mentioned chemical composition of the aluminum alloy A is compacted into a second green compact composed solely of the powdery material;

(3) A billet 40 is prepared, which has an inner layer formed of the first green compact, and an outer layer formed of the second green compact, and is formed therein with a central bore 40*a* having an elliptical cross section;

(4) The billet 40 thus prepared is preheated and placed into a container 41, where it is further heated therein to an appropriate temperature;

(5) A mandrel 43 having an elliptical cross section and fixed to a stem 42 is fitted through the bore 40*a* of the billet 40. The stem 42 is then pushed against the billet 40 to pressurize and forcibly extrude same through a die hole 44*a* in a die 44 (FIG. 4);

(6) A cam ring 1 thus formed by the hot extrusion is subjected to finish machining.

Figure 5:
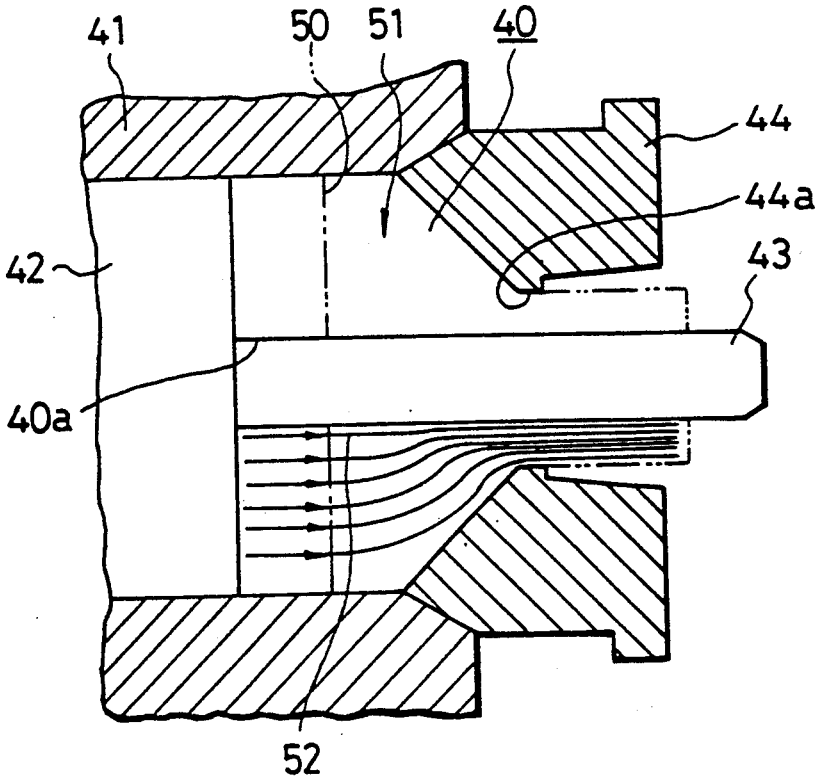
FIG. 5 is a sectional view of the die and the billet, showing the manner in which the billet is deformed during extrusion.

In the above step (5), as the stem 42 pressurizes the billet 40, no deformation takes place in a portion of the billet 40 which does not reach a deformation commencing point 50 indicated by the one-dot chain line in FIG. 5. In a region 51 downstream of the deformation commencing point 50 the billet 40 is deformed (steady-state deformation) in such a manner that the radially whole portions of the billet 40 parallelly move radially inward, as indicated by the parallel arrows in FIG. 5, to be finally extruded through the die hole 40*a* to the outside. However, the hard particles B dispersed in the inner peripheral surface portion of the billet 40 move along a nearly straight flow line 52 indicated by the innermost arrow in FIG. 5, as distinct from the other flow lines indicated by the outer arrows in the figure. Thus, the hard particles B are evenly dispersively distributed throughout the inner peripheral surface portion of the cam ring 1.

The aluminum alloy cam ring 1, which thus has hard particles B evenly dispersively distributed throughout the inner peripheral surface portion, has greatly increased seizure resistance and wear resistance as compared with the conventional cam rings. Further, since the hard particles B are dispersed only in the inner peripheral surface portion of the billet 40, the whole billet 40 has rather low hardness, and hence has improved extrusion formability, resulting in an enhanced production yield.

Alternatively of hard particles of a nitride, a carbide or the like dispersed in the inner peripheral surface portion of the billet 40, a material may be used, which is formed of an aluminum alloy having substantially the same chemical composition as the aluminum alloy A but in which the silicon is contained in a higher amount, preferably by approximately 3 percent by weight than the silicon content in the aluminum alloy A, providing improved seizure resistance as in the above described embodiment.

Further, the front and rear side blocks 2, 3 forming the cylinder together with the cam ring 1 may be formed of an aluminium alloy, which is preferably hot extruded and has substantially the same chemical composition as the aluminum alloy A, with hard particles B dispersed in opposed inner end face portions thereof, like the cam ring 1, providing equivalent results to those stated above.

Furthermore, the present invention is not limited to a vane compressor as in the above described embodiment, but it may be applied to other compressors such as swash-plate type compressors and wobble-plate type compressors, in which the inner peripheral surface portion of a cylinder formed of an aluminum alloy, preferably formed by hot extrusion, within which a piston is slidably received, has hard particles dispersed therein.

What is claimed is:

1. In a compressor having a cylinder formed of an aluminum alloy and having an inner peripheral surface portion, and a moving member slidably received within said cylinder, the improvement wherein:

hard particles are evenly dispersed only in said inner peripheral surface portion of said cylinder and not throughout the entire extent of said cylinder;

said hard particles are formed of a chemical compound selected from the group consisting of $Si_3N_4$, TiC, and SiC; and said cylinder is formed by subjecting a green compact of a powdery material for said aluminum alloy to hot extrusion; and wherein said hard particles are dispersed only in an inner peripheral surface portion of said green compact which is thereafter subjected to said hot extrusion.

2. A compressor as claimed in claim 1, wherein said hard particles have a mean particle size of not more than approximately 10 microns.

3. A compressor as claimed in claim 1, wherein said aluminum alloy consists essentially of 13–17 percent by weight Si, 3–5 percent by weight Cu, 3–5 percent by weight Fe, and the balance of Al and inevitable impurities.

4. A compressor as claimed in claim 1, which is a vane compressor.

5. A compressor as claimed in claim 1, wherein said hard particles are contained in an amount of 1 to 8 percent by weight.

6. A compressor as claimed in claim 5, wherein said hard particles are contained in an amount of approximately 3 percent by weight.

* * * * *